US005312316A

United States Patent [19]

Wu

[11] Patent Number: 5,312,316

[45] Date of Patent: May 17, 1994

[54] MACHINE FOR FORMING CARDBOARD BOXES

[76] Inventor: Bor-Yih Wu, No. 67, Fuh Shing Street, Ren Der, Tainan, Taiwan

[21] Appl. No.: 58,402

[22] Filed: May 7, 1993

[51] Int. Cl.[5] ..... B31B 3/80; B31B 3/52

[52] U.S. Cl. ..... 493/123; 493/127; 493/141; 493/183; 493/316

[58] Field of Search ..... 493/123, 124, 125, 126, 493/127, 128, 141, 180, 181, 182, 183, 316

[56] References Cited

U.S. PATENT DOCUMENTS

| | | | |
|---|---|---|---|
| 2,289,820 | 7/1942 | Ardell | 493/316 |
| 4,285,682 | 8/1981 | Moss | 493/316 |
| 4,439,174 | 3/1984 | Derderian | 493/125 |
| 4,498,893 | 2/1985 | Odom | 493/125 |
| 4,632,666 | 12/1986 | Ulrich et al. | 493/183 |
| 5,156,582 | 10/1992 | Thompson | 493/316 |
| 5,186,706 | 2/1993 | Hartness et al. | 493/316 |

*Primary Examiner*—William E. Terrell

*Attorney, Agent, or Firm*—Pro-Techtor International

[57] ABSTRACT

The present invention concerns a machine for forming cardboard boxes. The principal feature is that the housing is square and consists of a supply tray, box-forming suction cup rocker arm assembly, four-joint tie bar folding assembly, rocker arm tie bar folding assembly, adjustable press plate assembly, side cover-forming plate, press setting assembly, adhesive sprayer and push plate. Cardboard boxes are formed in an automated manner and the bottom thereof is sealed automatically by means of synchronizing the movements of the components pertaining to the machine. Accordingly, the employment of the equipment pertaining to the present invention can bring about a reduction in operation costs and the floor space required.

2 Claims, 9 Drawing Sheets

MACHINE FOR FORMING CARDBOARD BOXES

The present invention concerns a machine for forming cardboard boxes. In light of the fact that conventional configurations are of large sizes, resulting in drawbacks such as occupying floor space and high operating costs, the inventors arrived at the present invention after implementing improvements with which a compact and more efficient configuration is obtained.

Conventional configurations (see FIGS. 1 and 2) principally consist of a supply tray, folding assembly and taping device. The supply tray is placed on one side of the sending assembly, resulting in an L-shaped overall configuration. The cardboard boxes are placed on the supply tray, and drawn to the sending assembly by drawing rollers. Next, the cardboard box is sent to the folding assembly from the sending assembly. Said folding assembly consists of a suction cup assembly, right-folding rocker arm, left-folding rocker arm, lower folding plate and press plate assembly. The cardboard box is formed into shape with the various pieces being folded by the actions of the folding assembly. The taping device is placed in the center of the rear section of the folding assembly, and the front of said taping device is equipped with a guide for guiding the upper and lower folding pieces to be sealed and taped. Cardboard boxes can be formed automatically by means of said configuration.

Even though the functionality of said configuration has been perfected, there are drawbacks with said configuration, including the facts that (1) the machine is bulky and occupies excessive floor space, resulting in valuable space being wasted, and higher operation costs, (2) safety is compromised and accidents can occur, because of the orientation of the supply tray, which faces toward the main assembly, and (3) said cardboard box-forming system is not adjustable and cannot be employed for boxes of different sizes.

In light of said fact that conventional configurations are of large sizes, resulting in drawbacks such as occupying floor space and high operating costs, the inventors arrived at the present invention after implementing improvements with which a compact and more efficient configuration is obtained.

Additionally, the following merits are realized with the aforementioned design improvements pertaining to the present invention:

1. If necessary, the supply tray pertaining to the present invention can be equipped with a conveyer belt system, so that the supply capacity can be increased and cardboard boxes can be replenished automatically.
2. Since the configuration pertaining to the present invention is square, the machine is compact and does not occupy excessive floor space, and a higher level of safety can be achieved.
3. The configuration pertaining to the present invention is of an adjustable-type, allowing it to be employed for boxes of various sizes.
4. Glueing is not required beforehand during packaging, thereby avoiding the inconvenience of empty boxes occupying space.
5. The configuration pertaining to the present invention is simple and easy to operate, merely requiring the replenishment of cardboard boxes, when depleted. Since the entire operation is automated, operation costs are reduced.

DESCRIPTION OF THE NOTATIONS

Figure 1:
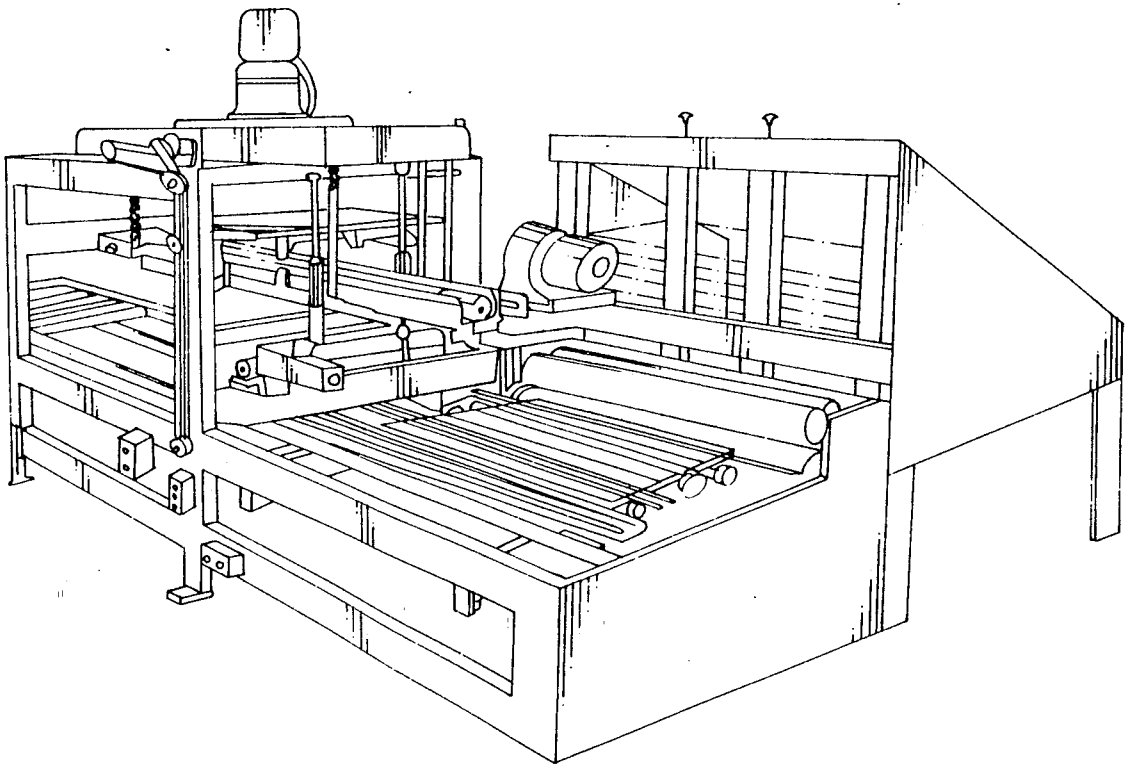
FIG 1 (PRIOR ART)
FIG. 1: A three-dimensional view of a conventional configuration.
Figure 2:
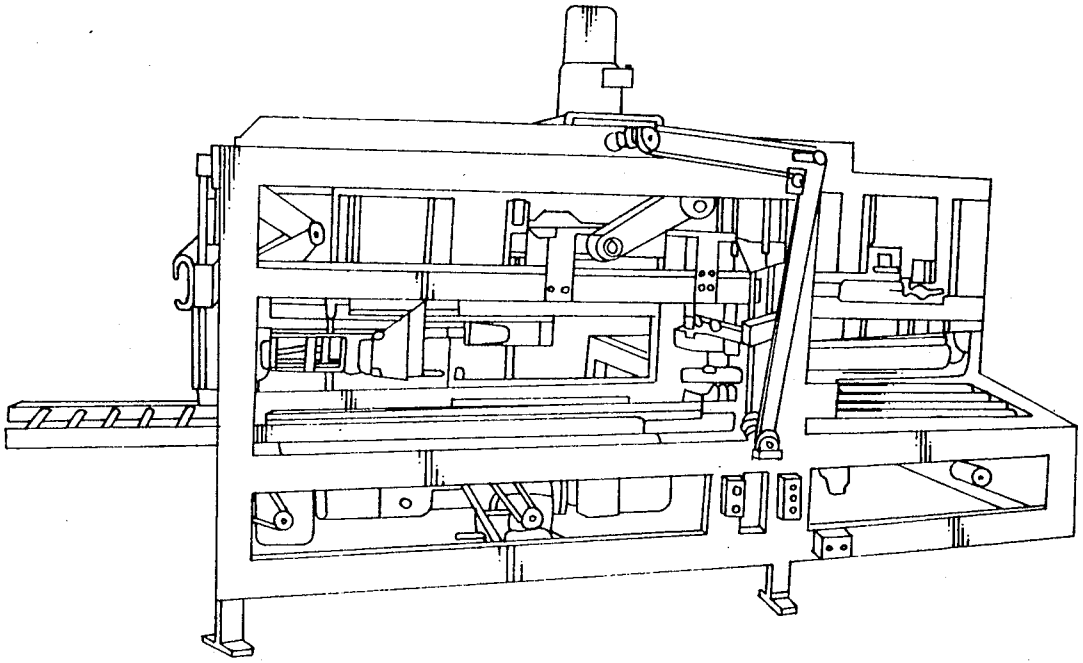
FIG2 (PRIOR ART)
FIG. 2: A front view of a conventional configuration.
Figure 3:
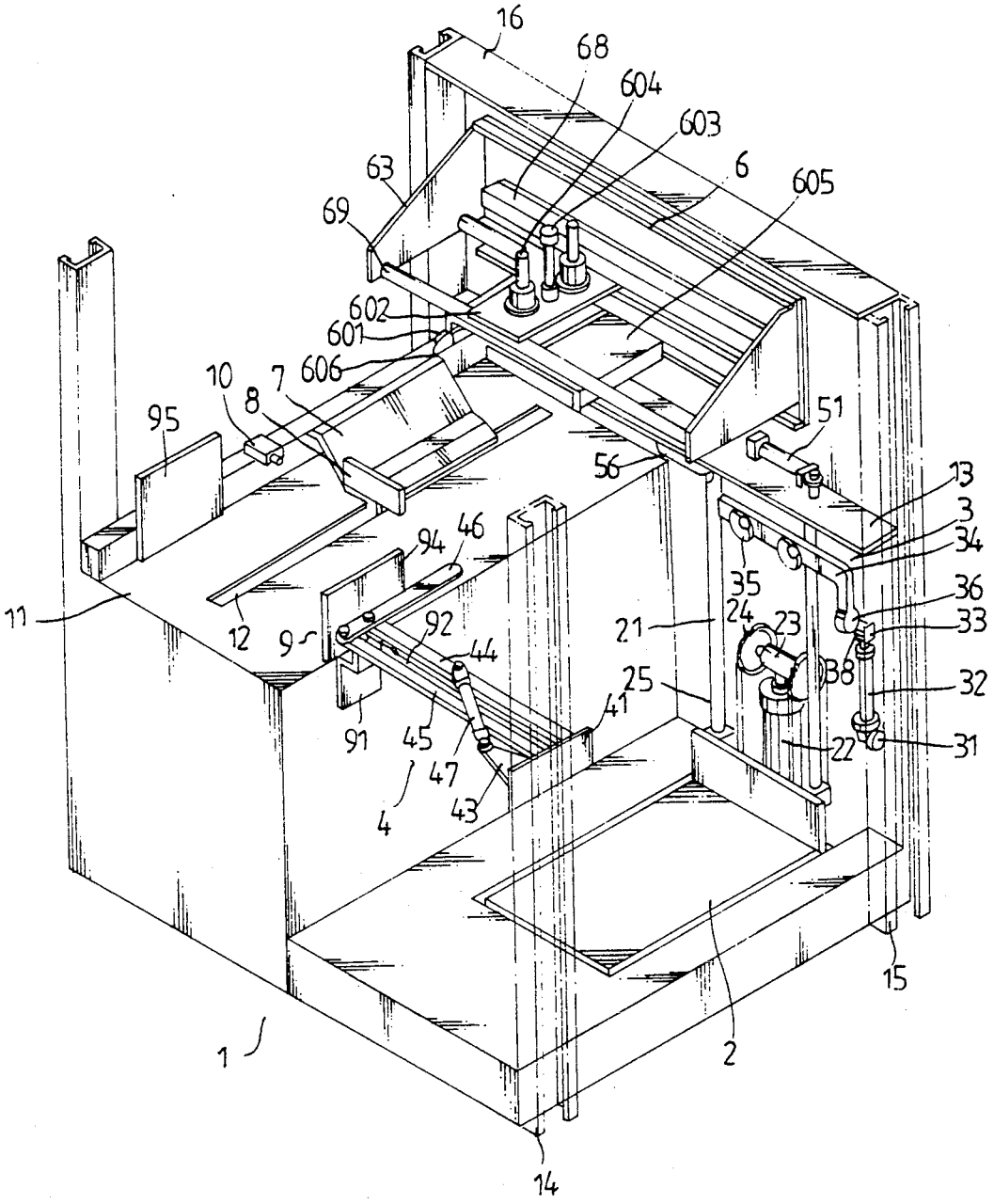
FIG. 3: A three-dimensional view of the configuration pertaining to the present invention.

1. Housing
2. Supply tray
3. Box-forming suction cup rocker arm assembly
4. Four-joint tie bar folding assembly
5. Rocker arm tie bar folding assembly
6. Adjustable press plate assembly
7. Side cover-forming plate
8. Push plate
9. Press setting plate
10. Adhesive sprayer
11. Table
12. Track
13. Rectangular separating plate
14. Supporting column
15. Supporting bar
16. Rectangular cover plate
21. Straight sliding rod
22. Elevating cylinder
23. Elevating axle
24. Elevating gear
25. Chain
26. Cardboard box
27. Front folding piece
28. Rear folding piece
29. Upper folding piece
30. Lower folding piece
31. Box-forming cylinder anchor
32. Box-forming cylinder
33. U-shaped piece
34. Box-forming suction cup rocker arm
35. Suction cup
36. Bearing
37. Rocker arm anchor -continued 38. Connecting rod
41. Rocker arm anchor
42. Four-joint tie bar anchor
43. Front folding cylinder anchor
44. Connecting rod
45. Connecting rod
46. Front folding rocker arm
47. Front folding cylinder
51. Rear folding cylinder
52. Rear folding cylinder anchor
53. U-shaped piece
54. Folding rocker arm connecting rod
55. Rocker arm centering sleeve
56. Rear folding rocker arm
61. Straight sliding rod
62. Adjusting screw
63. Adjustable press plate housing
64. Tapered gear
65. Tapered gear
66. Transverse adjusting rod
67. Adjusting handle
68. Strut-less cylinder
69. Transverse sliding rod
81. Straight sliding rod
82. Strut-less cylinder
91. Press setting cylinder anchor
92. Press setting cylinder
93. Straight sliding rod
94. Press setting plate
95. Limiting plate
601. Press plate
602. Sliding plate
603. Elevating cylinder
604. Elevating slide rod
605. Push plate
606. Incline plate As shown in FIG. 3, the system pertaining to the present invention consists of a housing 1, supply tray 2, box-forming suction cup rocker arm assembly 3, four-joint tie bar folding assembly 4, rocker arm tie bar folding assembly 5, adjustable press plate assembly 6, side cover-forming plate 7, push plate 8, press setting plate 9 and adhesive sprayer 10.

Figure 5:
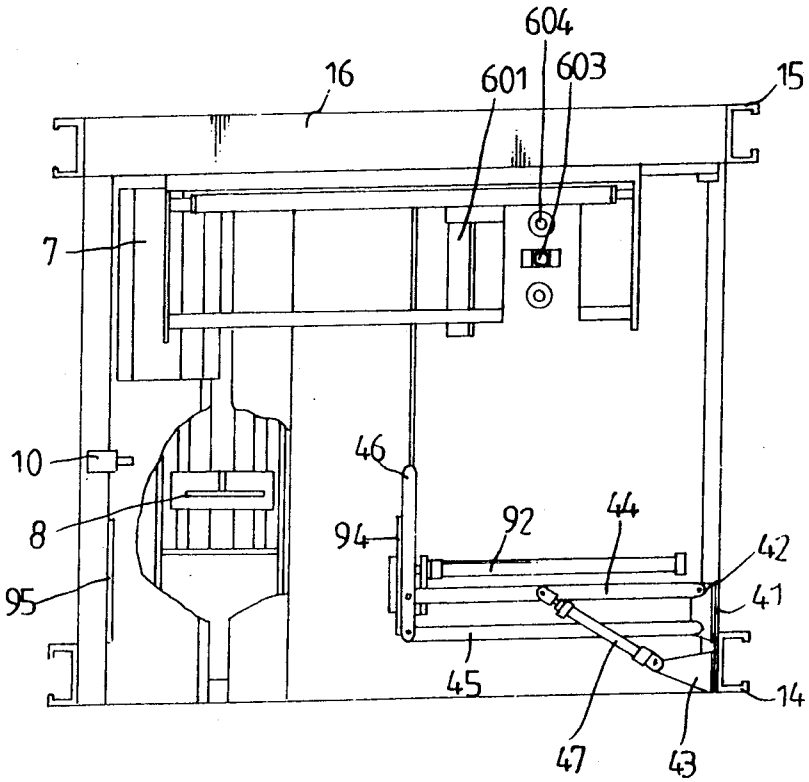
FIG. 5: A top view of the configuration pertaining to the present invention.
Figure 4:
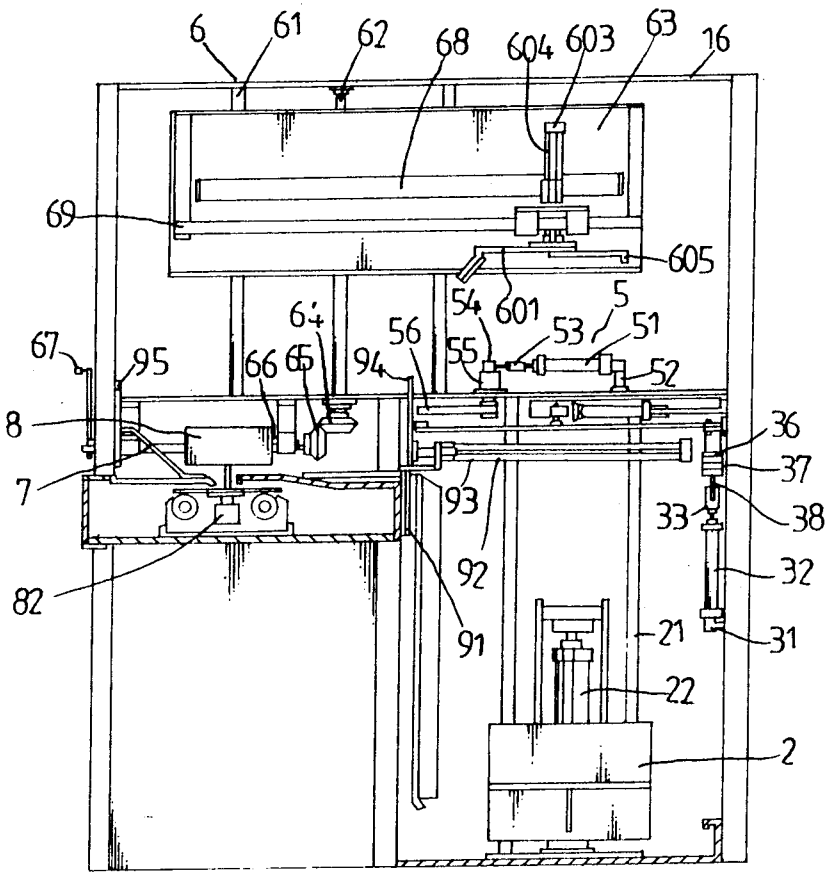
FIG. 4: A front view of the configuration pertaining to the present invention.
Figure 6:
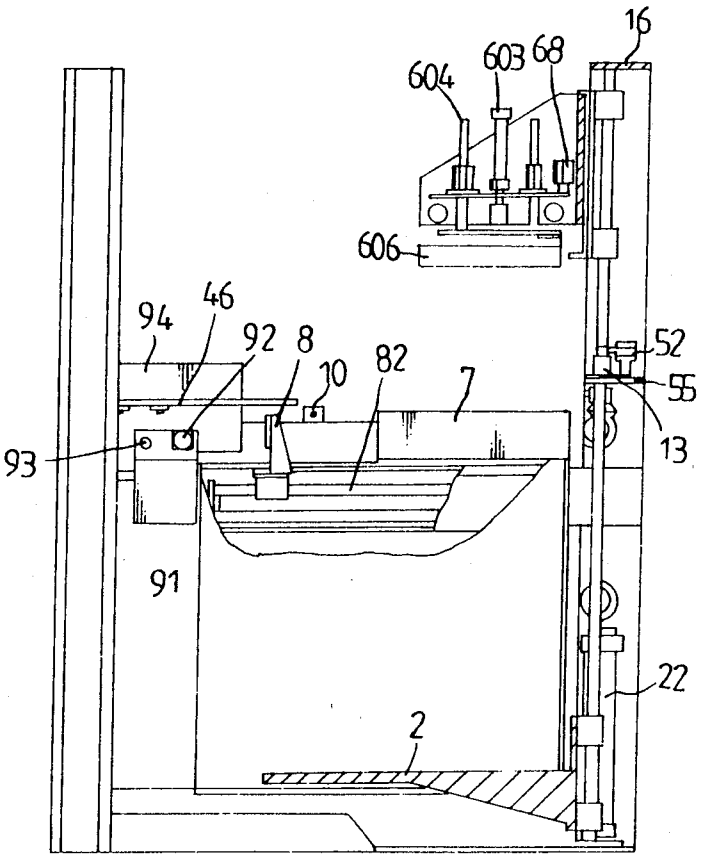
FIG. 6: A right-side view of the configuration pertaining to the present invention.

The housing 1 is square with an open interior. The left half is equipped with a table 11 of a specific height, the surface of the table 11 is equipped with a track 12, and the inside of the track 12 is equipped with a straight sliding rod 81 and strut-less cylinder 82 for the push plate 8 (see FIGS. 4 and 5). The lower part of the push plate 8 is anchored to the strut-less cylinder 82, and said strut-less cylinder causes said plate to move. The push plate 8 is placed outside of the track 12. A press setting cylinder anchor 91 is placed at a specific site on the right side of the table 11, and the right side of the press setting cylinder anchor 91 is equipped with a press setting cylinder 92 and straight sliding rod 93 (see FIG. 6), with their front ends being inserted through the press setting cylinder anchor 91 and bound to a press setting plate 94. A limiting plate 95 is placed at a position opposite from the press setting plate 94, and operates together with the press setting plate 94 to set the cardboard box in place. An adhesive sprayer 10 is placed behind the limiting plate 95, and a side cover-forming plate 7 with a shape of "⅃" is placed at an appropriate position behind the adhesive sprayer 10. A chamber is situated on the right lower side of the table 11, and a rectangular separating plate 13 is placed at a specific location on the rear of the housing 1. The supply tray 2 is placed in the chamber, the rear of said chamber is equipped with two straight sliding rods 21, and the upper and lower parts thereof are bound to the rectangular separating plate 13 and the bottom of the housing 1 respectively, thereby governing the position of the elevating supply tray 2. An elevating cylinder 22 is anchored between the two straight sliding rods 21 and equipped with an elevating axle 23. The two ends of the elevating axle 23 are each equipped with an elevating gear 24. The elevating gear 24 is equipped with a chain 25, and the chain 25 is bound to the supply tray 2, thereby allowing the supply tray to be raised or lowered by means of the action of the elevating cylinder 22. The right side of the housing 1 is equipped with two supporting columns 14 and 15, and a rocker arm anchor 41 is secured at a specific location on the supporting column 14. The rocker arm anchor 41 is equipped with a four-joint tie bar anchor 42 and front folding cylinder anchor 43 (see FIG. 5). Two connecting rods 44 and 45 are connected to the four-joint tie bar anchor 42 by means of pivot joints, and the front of the two connecting rods 44 and 45 are connected to a front folding rocker arm 46 by means of pivot joints; the configuration is designed in such a way that the two connecting rods 44 and 45 are parallel. The front of a front folding cylinder 47 is connected to a specific site on the connecting rod 44 by means of a pivot joint, while the bottom of said front folding cylinder 47 is connected to the front folding cylinder anchor 43 by means of a pivot joint, thereby forming the four-joint tie bar folding assembly 4. A box-forming cylinder anchor 31 is placed at a specific site on the supporting column 15. The bottom of a box-forming cylinder 32 is bound to the box-forming cylinder anchor 31, and the front is equipped with a U-shaped piece 33. The arm of a box-forming suction cup rocker arm 34 possesses a 90° angle, with the horizontal part of the arm equipped with several suction cups 35 and the the perpendicular part of the arm equipped with a bearing 36. The bearing 36, which functions as the fulcrum of the box-forming suction cup rocker arm 34, is placed on a rocker arm anchor 37 secured onto the supporting rod 15, as shown in FIG. 3. One end of the bearing 36 has a connecting rod 38, which forms an angle with the perpendicular part of the arm and is connected to a U-shaped piece 33 equipped on the front of the box-forming cylinder 32 by means of a pivot joint. The upper side of the rectangular separating plate 13 is equipped with a rear folding cylinder 51, and the bottom thereof is secured onto a rear folding cylinder anchor 52. The front of said rear folding cylinder 51 is equipped with a U-shaped piece 53, which is connected to a folding rocker arm connecting rod 54 by means of a pivot joint and forms an angle with said rod 54 (see FIG. 9). The shaft of the folding rocker arm connecting rod 54 is inserted into the lower side of the rectangular separating plate 13 through a rocker arm centering sleeve 55 bound to the rectangular separating plate 13. Additionally, the end of said shaft in the lower side of the rectangular separating plate 13 is equipped with a rear folding rocker arm 56 in such a manner that the rear folding rocker arm 56 and the front folding rocker arm 46 are at the same height. The rear upper part of the housing 1 is also equipped with a rectangular cover plate 16. The upper and lower ends of two straight sliding rods 61 pertaining to the adjustable press plate assembly 6 are bound to the rectangular cover plate 16 and rectangular separating plate 13 respectively, and the resulting configuration governs the up-down position of an adjustable press plate housing 63. In addition, the upper end of an adjusting screw 62 is bound to the rectangular cover plate 13 and the lower end is inserted through the rectangular separating plate 13 and is equipped with a tapered gear 64. Said tapered gear 64 is then coupled with a tapered gear 65 on the right side of a transverse adjusting rod 66. The left side of the transverse adjusting rod 66 is extended beyond the housing 1, and is equipped with an adjusting handle 67, which can be employed to raise or lower the adjustable press plate housing 63. The adjustable press plate housing 63 is equipped with a strut-less cylinder 68 and two transverse sliding rods 69 at specific locations. A sliding plate 602 pertaining to a press plate 601 is placed on the two transverse sliding rods 69, allowing it to slide along said transverse sliding rods 69, and the rear of said sliding plate 602 is bound to the bottom of the strut-less cylinder 68. With this configuration, the desired transverse position of the press plate 601 is achieved by the movement of the strut-less cylinder 68 and the governing of the two transverse sliding rods 69. The top of the sliding plate 602 is equipped with an elevating cylinder 603 and two elevating sliding rods 604, and the lower parts of these components are inserted through the sliding plate 602 and bound to the press plate 601, thereby controlling the up-down movement of the press plate 601. The left side of the press plate 601 is bent downward at an angle of 90° at a specific location, and the lower side of said left side of the press plate is equipped with an incline plate 606 with a certain incline angle. The right lower side of the press plate 601 is equipped with a push plate 605, and the right side of the push plate 605 is bent downward at an angle of 90° at a specific location. Additionally, the push plate 605 can be adjusted sideways to accommodate boxes of different sizes.

Figure 7:
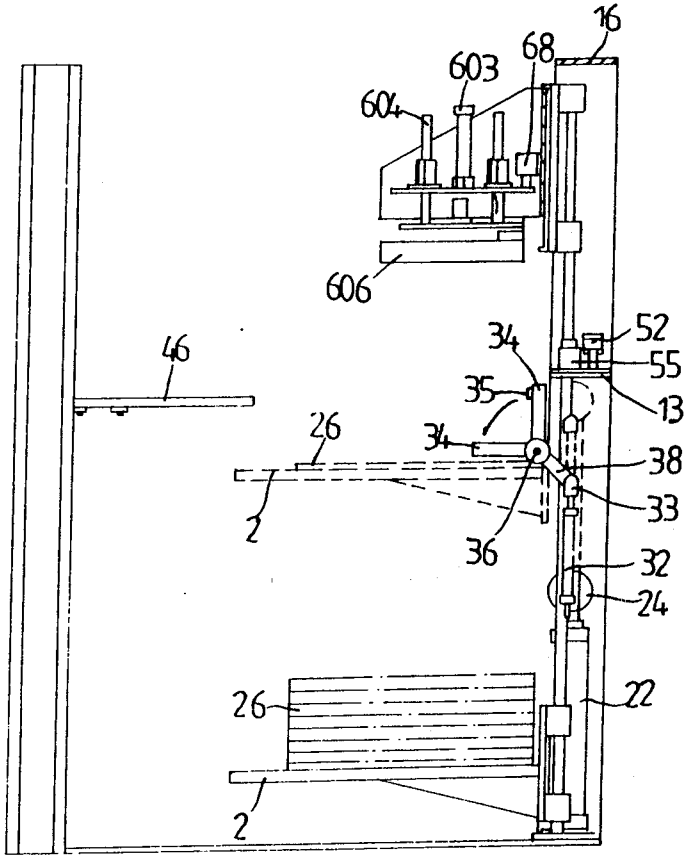
FIG. 7: An indicative figure showing the supply tray and the operation of the suction cup rocker arm assembly pertaining to the present invention.
Figure 9:
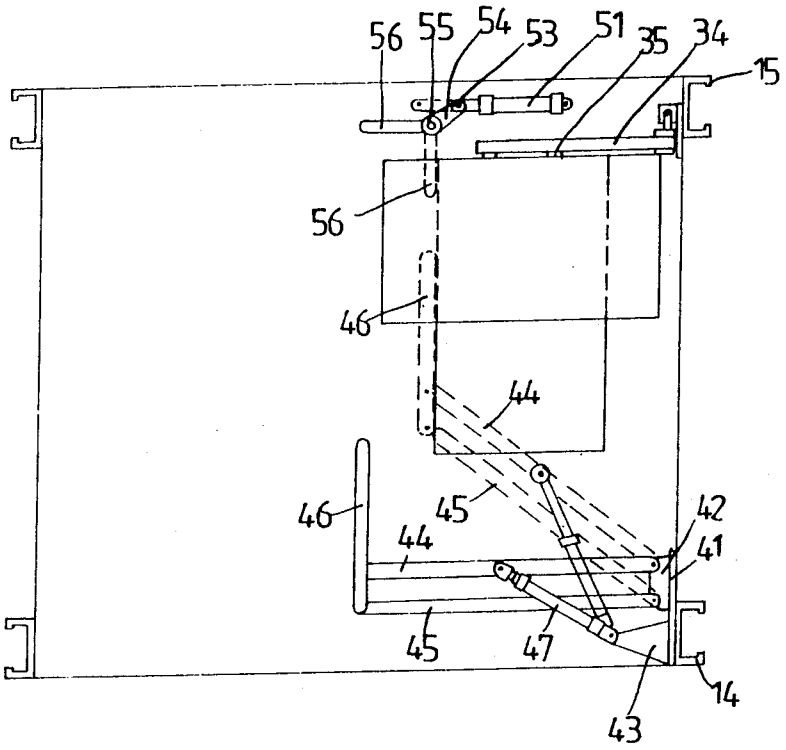
FIG. 9: An indicative figure showing the operation of the four-joint tie bar folding assembly and rocker arm tie bar folding assembly pertaining to the present invention.
Figure 8:
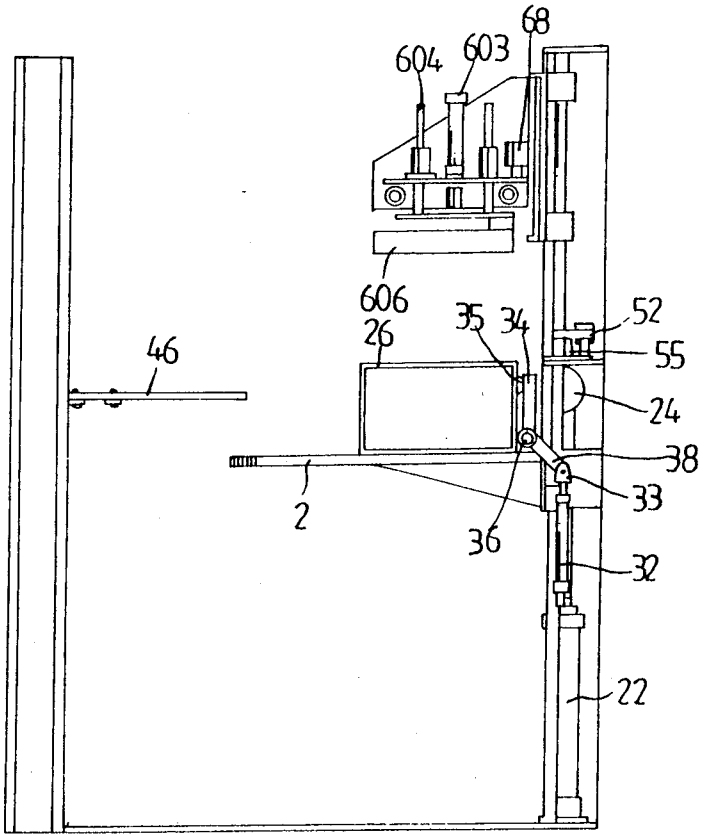
FIG. 8: An indicative figure showing the operation of the suction cup rocker arm assembly pertaining to the present invention.
Figure 11:
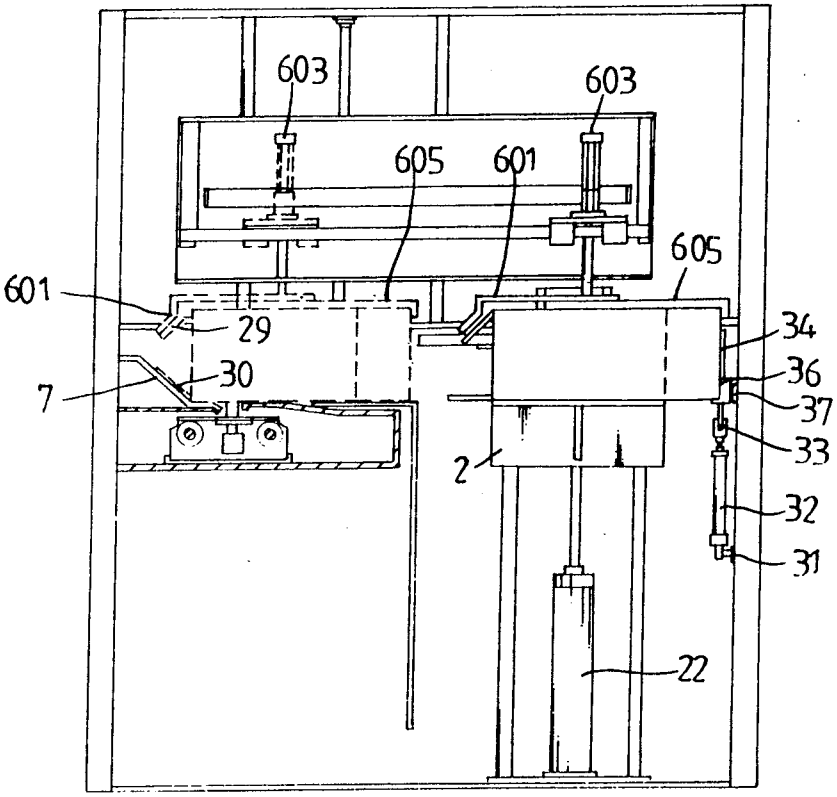
FIG. 11: An indicative figure showing the operation of the adjustable press plate assembly pertaining to the present invention.
Figure 10:
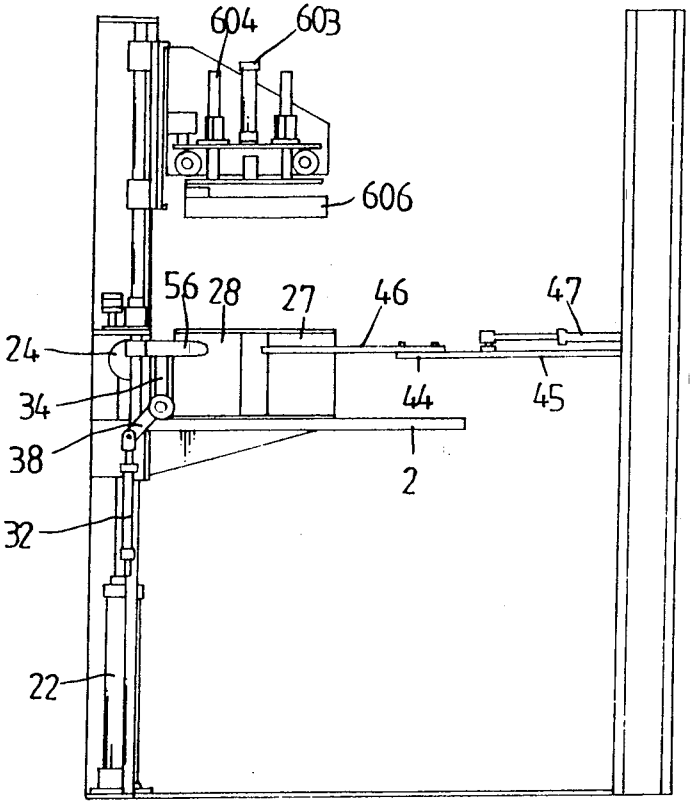
FIG. 10: An indicative figure showing the operation of the four-joint tie bar folding assembly and rocker arm tie bar folding assembly pertaining to the present invention.
Figure 13:
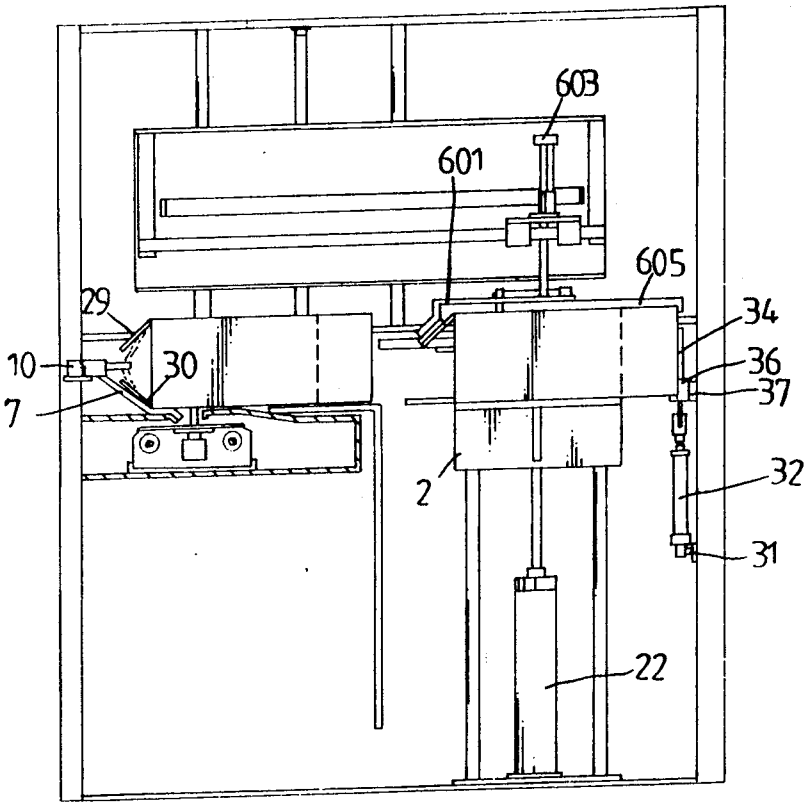
FIG. 13: An indicative figure showing the operation of the adhesive sprayer pertaining to the present invention.
Figure 12:
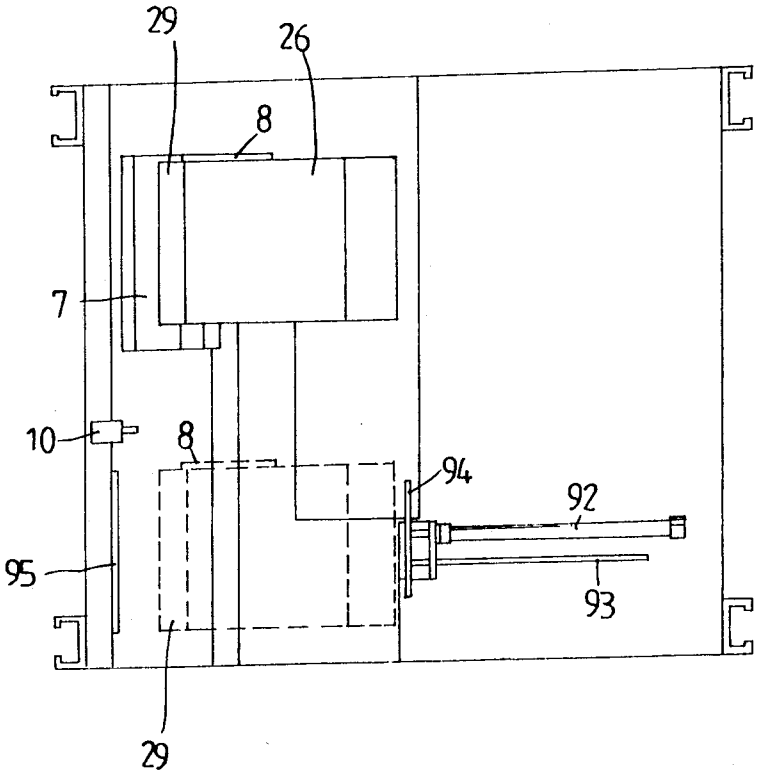
FIG. 12: An indicative figure showing the operation of the push plate pertaining to the present invention.
Figure 14:
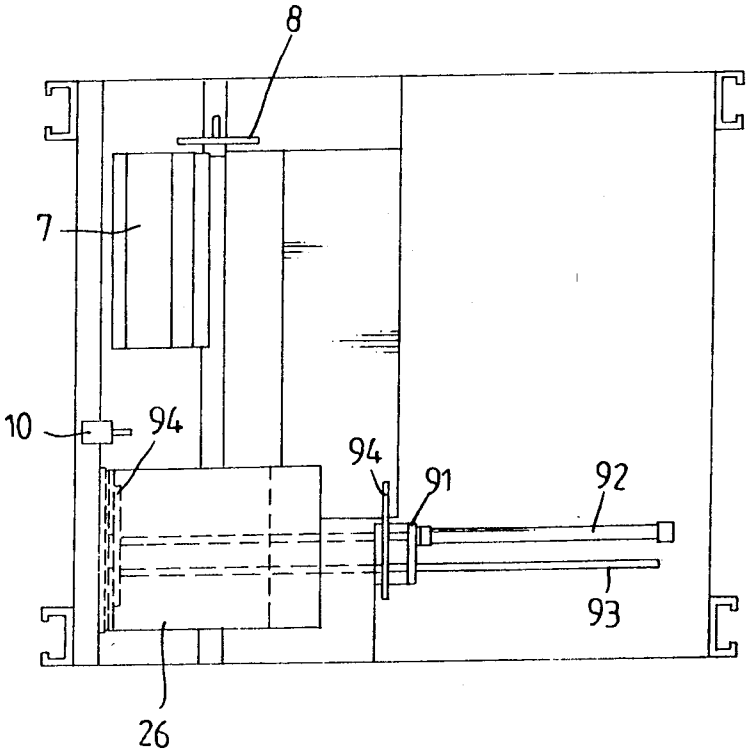
FIG. 14: An indicative figure showing the operation of the press setting plate pertaining to the present invention.

The practical application of the configuration described above is depicted in FIGS. 6 to 13. When the supply tray 2 is elevated by the elevating cylinder 22 to a specific position, the box-forming suction cup rocker arm assembly 3 becomes actuated upon receiving a signal from an electronic sensor, causing the box-forming cylinder 32 to move upward and then downward. The box-forming suction cup rocker arm 34 follows the motions of the box-forming cylinder 32, first moving downward at an angle of 90° to a horizontal position and then immediately returning to its initial position. When the box-forming suction cup rocker arm 34 is at the horizontal position, the suction cups 35 on said rocker arm 34 come into contact with the surface of the cardboard box 26, as shown in FIG. 7, and when said rocker arm 34 returns to its initial position, the cardboard box 26 bound to the suction cups is formed into shape, as shown in FIG. 8. The four-joint tie bar folding assembly 4 and rocker arm tie bar folding assembly 5 become actuated after the cardboard box 26 is formed into shape. The actuation of the front folding cylinder 47 causes the four-joint tie bar folding assembly 4 to become a parallelogram, as shown in FIGS. 8 and 9, and brings about the folding of the front folding piece 27 of the cardboard box 26 by the front folding rocker arm 46 at the front of said assembly 4. The actuation of the rear folding cylinder 51 causes the folding rocker arm connecting rod 54 to move and the rear folding rocker arm to turn at a 90° angle, thereby bringing about the folding of the rear folding piece 28 of the cardboard box 26. Next, the adjustable press plate assembly 6 moves down, and the elevating cylinder 603 causes the press plate 601 to move downward. The upper folding piece 29 of the cardboard box 26 is folded at a certain angle by the incline plate 606 on the press plate 601, and the right side of the cardboard box 26 is held by the bend on the right side of the push plate 605, as shown in FIGS. 10 and 11. After the downward operation step of the press plate 601 is complete, the four-joint tie bar folding assembly 4 and rocker arm tie bar folding assembly 5 return to their initial positions immediately. Next, the strut-less cylinder 68 pushes the sliding plate 602, thereby causing the press plate 601 and push plate 605 to move to the left. Since the cardboard box 26 is secured by the press plate 601 and push plate 605, it moves to the table 11 on the left side of the housing 1. When the lower folding piece 30 of the cardboard box 26 comes into contact with the side cover-forming plate 7, the incline surface thereof causes said lower folding piece 30 to fold inward. Next, the push plate 8 sends the cardboard box 26 to a corresponding position opposite from the press setting plate 94 and limiting plate 95, as shown in FIG. 12. During the process in which the cardboard box 26 is pushed by the push plate 8, said cardboard box passes by an adhesive sprayer 10, and said sprayer sprays an adhesive evenly onto the surfaces of the upper folding piece 29 and lower folding piece 30, as shown in FIG. 13. After the cardboard box 26 is pushed to the corresponding position opposite from the press setting plate 94, the press setting cylinder 92 is actuated, bringing the press setting plate 94 to the left and then inserting said plate 94 into the cardboard box 26. Said plate 94 continues moving to the left until it is pressed against the limiting plate 95, causing the upper and lower folding pieces 29 and 30 to bind to the front and rear folding pieces 27 and 28, as shown in FIG. 14. Since the actuations of the aforementioned components are controlled by electronic sensors and are continuous repetitive motions, the entire operation is automated.

I claim:

1. A machine for forming cardboard boxes principally consisting of (a) a housing, which is square with an open interior, equipped with a table of specific height on the left half of said housing, a chamber on the right side of said table, a rectangular separating plate placed at a specific location on the rear of said housing, a rectangular cover plate on the rear upper part of said housing, two supporting columns on the right and left sides, a track on the table, a push plate on said track (the push plate being situated outside of said track, while the bottom of said push plate being secured to a strut-less cylinder), a press setting cylinder anchor placed at a specific site on the right side of said table, a press setting cylinder and straight sliding rod secured on the right side of said press setting cylinder anchor, with their front ends being inserted through said press setting cylinder anchor and bound to a press setting plate, a limiting plate placed at a position opposite from said press setting plate, an adhesive sprayer placed behind said limiting plate, and a side cover-forming plate with a shape of "⊢" placed at an appropriate position behind said adhesive sprayer, (b) a supply tray situated in said chamber, with the rear of said supply tray being placed on two straight sliding rods, the upper and lower parts thereof being bound to said rectangular separating plate and the bottom of said housing respectively, thereby governing the position of the elevating supply tray, an elevating cylinder being anchored between said two straight sliding rods, the top of said elevating cylinder being equipped with an elevating axle, each of the two ends of said elevating axle being equipped with an elevating gear, said elevating gear being equipped with a chain, and said chain being bound to the rear of said supply tray, (c) a four-joint tie bar folding assembly situated on the right front supporting column of said housing, with a rocker arm anchor being secured at a specific location on said supporting column, said rocker arm anchor being equipped with a four-joint tie bar anchor and front folding cylinder anchor, two connecting rods being connected to said four-joint tie bar anchor by means of pivot joints, the front of said two connecting rods being connected to a front rocker arm by means of pivot joints in such a way that said two connecting rods are parallel, the front of a front folding cylinder being connected to a specific site on said connecting rod by means of a pivot joint, and the bottom of said front folding cylinder being connected to said front folding cylinder anchor by means of a pivot joint, thereby forming said four-joint tie bar folding assembly, (d) a box-forming suction cup rocker arm assembly situated on the right rear supporting column of said housing, with a box-forming cylinder anchor being placed at a specific site on said supporting column, the bottom of a box-forming cylinder being bound to said box-forming cylinder anchor, the front of said box-forming cylinder being equipped with a U-shaped piece, the arm of a box-forming suction cup rocker being curved, exhibiting a 90° angle, the horizontal part of said arm being equipped with several suction cups and the perpendicular part of said arm being equipped with a bearing, said bearing, which functions as the fulcrum of said box-forming suction cup rocker arm, being placed on a rocker arm anchor secured onto said supporting rod, and a connecting rod on one end of said bearing being at an angle with the perpendicular part of said arm and connected to the U-shaped piece equipped on the front of said box-forming cylinder by means of a pivot joint, (e) a rocker arm tie bar folding assembly situated on the upper side of said rectangular separating plate, with a rear folding cylinder anchor being placed at a specified site on said rectangular separating plate, a rear folding cylinder being placed at a horizontal configuration, the bottom thereof being secured onto said rear folding cylinder anchor and the front thereof being equipped with a U-shaped piece, connecting to a folding rocker arm connecting rod by means of a pivot joint and forming an angle with said rod, the shaft of said folding rocker arm connecting rod being inserted into the lower side of said rectangular separating plate through a rocker arm centering sleeve bound to said rectangular separating plate, and the end of said shaft in the lower side of said rectangular separating plate being equipped with a rear folding rocker arm in such a manner that said rear folding rocker arm and said front folding rocker arm are at the same height, and (f) an adjustable press plate assembly situated on the rear upper part of said housing, with the upper and lower ends of two straight sliding rods pertaining to the adjustable press plate assembly being bound to the rectangular cover plate and rectangular separating plate respectively, thereby governing the up-down position of said adjustable press plate assembly, a strut-less cylinder and two transverse sliding rods being placed at specific positions of said adjustable press plate assembly, a sliding plate pertaining to a press plate being placed on the two transverse sliding rods and the rear of said sliding plate being bound to the bottom of said strut-less cylinder, the top of said sliding plate being equipped with an elevating cylinder and two elevating sliding rods and the lower parts of said components being inserted through said sliding plate and bound to said press plate, the left side of said press plate being bent downward at an angle of 90° at a specific location and the lower side of said left side of the press plate being equipped with an incline plate with a certain incline angle, the right lower side of said press plate being equipped with a push plate and the right side of said push plate being bent downward in a perpendicular manner, and said push plate being capable of being adjusted sideways to accommodate boxes of different sizes.

2. A machine for forming a cardboard boxes according to claim 1, which is characterized by the fact that cardboard boxes are formed in an automated manner and the bottom thereof is sealed automatically by means of synchronizing the movements of the components pertaining to said machine.

* * * * *